US010774399B2

(12) United States Patent
Bakeev et al.

(10) Patent No.: US 10,774,399 B2
(45) Date of Patent: Sep. 15, 2020

(54) HYDROLYZED STARCHES AS GRINDING AIDS FOR MINERAL ORE PROCESSING

(71) Applicant: SOLENIS TECHNOLOGIES, L.P., Wilmington, DE (US)

(72) Inventors: Kirill Bakeev, Newark, DE (US); Andrew M DiMaio, Glen Mills, PA (US); Zoha Al-Badri, West Grove, PA (US)

(73) Assignee: SOLENIS TECHNOLOGIES, L.P., Wilmington, DE (US)

( * ) Notice: Subject to any disclaimer, the term of this patent is extended or adjusted under 35 U.S.C. 154(b) by 1345 days.

(21) Appl. No.: 14/299,508

(22) Filed: Jun. 9, 2014

(65) Prior Publication Data

US 2015/0008272 A1 Jan. 8, 2015

Related U.S. Application Data

(60) Provisional application No. 61/842,188, filed on Jul. 2, 2013.

(51) Int. Cl.

| | |
|---|---|
| ***C22B 1/00*** | (2006.01) |
| ***B02C 23/18*** | (2006.01) |
| ***B02C 19/00*** | (2006.01) |
| ***B02C 17/18*** | (2006.01) |

(52) U.S. Cl.

CPC ..... *C22B 1/00* (2013.01); *B02C 17/186* (2013.01); *B02C 19/0056* (2013.01); *B02C 23/18* (2013.01)

(58) Field of Classification Search

CPC ..... B02C 17/00; B02C 17/186; B02C 23/00; B02C 23/06; B02C 23/18; B02C 19/0056; C22B 1/00; C22B 3/00; C22B 21/0015; B22F 9/04; B22F 9/042

USPC ..... 241/15, 16

See application file for complete search history.

(56) References Cited

U.S. PATENT DOCUMENTS

| | | | | |
|---|---|---|---|---|
| 2,145,206 | A | 1/1939 | Booth | |
| 3,339,730 | A | 9/1967 | Pierre et al. | |
| 3,796,308 | A | 3/1974 | McInlhinney et al. | |
| 3,950,182 | A * | 4/1976 | Steel | B02C 23/06 106/476 |
| 4,274,599 | A | 6/1981 | Manfroy et al. | |
| 5,131,600 | A | 7/1992 | Klimpel et al. | |
| 5,328,690 | A | 7/1994 | Sikes | |
| 5,799,882 | A | 9/1998 | Klimpel | |
| 8,440,754 | B2 | 5/2013 | Mongoin et al. | |
| 9,029,448 | B2 | 5/2015 | Gane et al. | |

(Continued)

FOREIGN PATENT DOCUMENTS

| | | |
|---|---|---|
| CN | 101337204 | 1/2009 |

OTHER PUBLICATIONS

Pearse—An overview of the use of chemical reagents in mineral processing; Minerals Engineering 18 (2005), 139-149.*

(Continued)

*Primary Examiner* — Shelley M Self
*Assistant Examiner* — Katie L. Parr
(74) *Attorney, Agent, or Firm* — Lorenz & Kopf, LLP

(57) ABSTRACT

Grinding aid compositions comprising hydrolyzed starches, such as dextrin, maltodextrin or corn syrup solids. The grinding aid compositions are typically added to various mineral ore slurries prior to grinding operations to affect the rheology characteristics of the mineral ore slurries.

18 Claims, 3 Drawing Sheets

(56) References Cited

U.S. PATENT DOCUMENTS

| | | | | |
|---|---|---|---|---|
| 2009/0314529 | A1* | 12/2009 | Petersen | C09D 11/30 174/257 |
| 2016/0017079 | A1* | 1/2016 | Rodrigues | C08F 251/02 526/200 |

OTHER PUBLICATIONS

Pearse—An overview of the use of chemical reagents in mineral processing; Minerals Engineering 18 (2005), 139-149 (Year: 2005).*
Stickiness test—Google Search_Dec. 2018 (Year: 2018).*
Sticky _ Definition of Stickiness by Merriam-Webster_Dec. 2018 (Year: 2018).*
Viscosity_Definition of Viscosity by Merriam-Webster_Dec. 2018 (Year: 2018).*
Pearse et al, "An overview of the use of chemical reagents in mineral processing", Minerals Engineering, Pergamon Press, Oxford, GB, vol. 18 No. 2, Feb. 1, 2005, pp. 139-149.
PCT International Search Report, dated Nov. 13, 2014, pp. 1-2.
National Institute of Industrial Property Ministry of Economy, Official Action in Chilean Patent Application No. 201503795 dated Jul. 17, 2017.

* cited by examiner

Power Draw (Blank)

Power Draw (after subtraction of blank)

HYDROLYZED STARCHES AS GRINDING AIDS FOR MINERAL ORE PROCESSING

This application claims the benefit of U.S. provisional application No. 61/482,188, filed 2 Jul. 2013, the entire contents of which are hereby incorporated by reference.

BACKGROUND OF THE INVENTION

The invention relates to compositions which enhance the effectiveness of grinding mineral ore slurry. The compositions comprise hydrolyzed starch. Typically the compositions are added to mineral ore slurry prior to or during the process of comminuting the mineral ore in a mineral mining process.

The mineral industry is a large consumer of chemicals which are used during many stages of the processing of mineral ore. For example, chemicals are added to facilitate grinding of large chunks of mineral ore into finer particles of ore. Once the ore has been reduced to the appropriate size, the mineral fines can be extracted and transformed into a useful product.

The grinding of mineral ore is a very energy intensive and inefficient stage of mineral ore processing. In an effort to make the process more efficient and cost effective, mechanical and chemical adaptations have been developed to facilitate the comminution of mineral ore. One such adaptation is the introduction of chemicals which are effective in making the grinding process more efficient. These classes of chemicals can generally be referred to as grinding aids. Grinding aids can directly lower the energy of the comminution (i.e. grinding) process and allow for more efficient throughput of mineral ore. These chemical additives also have been shown to increase the level of fines produced during the grinding stage thus increasing efficiency.

Chemicals, and chemical combinations, that have been shown to enhance grinding in mining operations include carboxy methyl cellulose, styrene and maleic anhydride, glycerol and anionic polyacrylates. However, the mining industry is constantly seeking new additive technologies that will increase the efficiency of the comminution process and overall ore recovery in mineral mining operations. Further, due to increased environmental concerns over mining operations, grinding aid additives comprising natural materials that will provide decreased environmental harm are desired.

All parts and percentages set forth herein are on a weight-by weight basis unless otherwise indicated.

SUMMARY OF THE INVENTION

The compositions useful as grinding aids in mining operations comprise hydrolyzed starch. These compositions are typically added to mineral slurry prior to or during a grinding stage in a mineral ore recovery process. Thus, the invention encompasses mineral ore slurry comprising an aqueous phase comprising a mineral ore and a grinding aid comprising a hydrolyzed starch in an amount effective to comminute the mineral ore.

Generally, application of the hydrolyzed starch increases the capacity and throughput of mineral ores during the grinding stage in mining processes, particularly in recovery of mineral fines from ore. This will benefit operations by decreasing downtime and moving more ore through the comminution process in shorter time periods. Improvement in ore slurry flow-ability at a given throughput will result in reduction of ore slurry pumping energy for ore discharged from the mill and transported to the next destination point in a mill circuit.

DETAILED DESCRIPTION OF THE INVENTION

Figure 1:
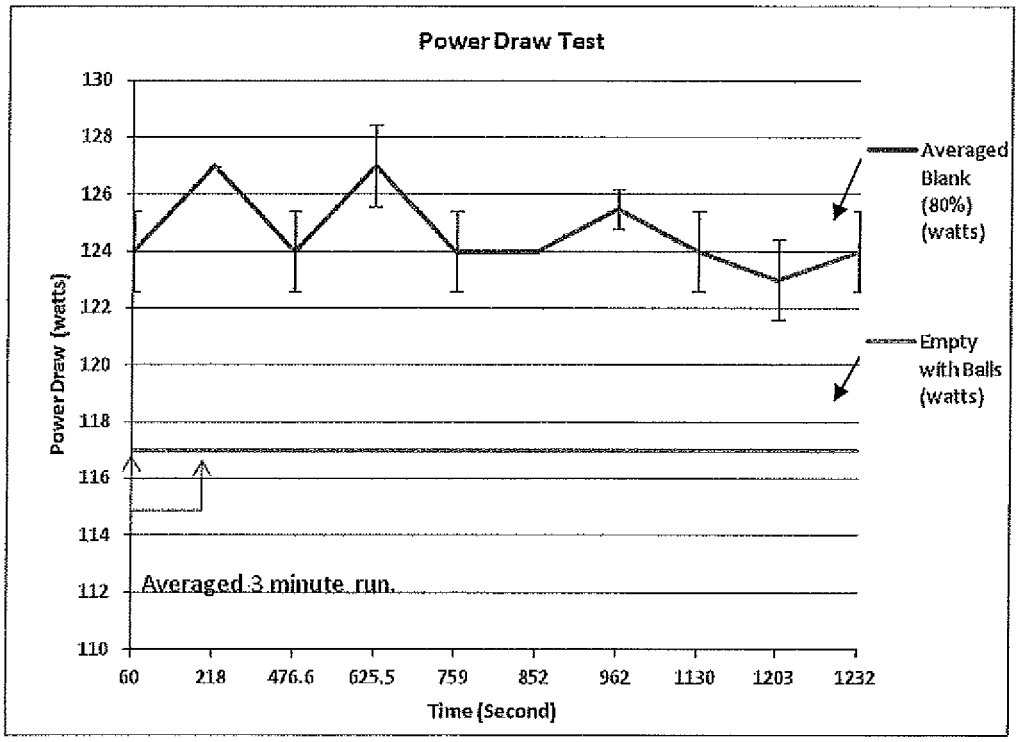
FIG. 1, shows a general schematic of the main features of the improved process of delivering an emulsion to a brown-stock vessel.

Useful hydrolyzed starches include non-ionic low molecular weight species. In embodiments, the grinding aid compositions comprise hydrolyzed starch selected from the group consisting of dextrin, maltodextrin, corn syrup solids, and the like, and combinations thereof. The grinding aid composition may consist or consist essentially of the hydrolyzed starch.

Generally, grinding is the process in a commercial mining operation in which larger fragments of ore are broken down to particles of very fine particle sizes, i.e. the fines. The valuable minerals are extracted from the fines. The grinding process occurs in one or more means for comminuting mineral ore, such as ball mills, rod mills, autogenous mills, semi-autogenous ("SAG") mills, pebble mills, high pressure grinding mills, burhstone mills, vertical shift impactor mills, tower mills and the like. Ball mills, SAG mills, rod mills and high pressure grinding roll mills are preferably used in industrial mining operations. The grinding aid composition facilitates the comminution of the mineral ore fragments in the mineral ore slurry thus allowing grinding to the desired particle size with less energy requirements. The grinding aid composition also affects the rheology of the mineral ore slurry allowing it to flow within the mill better, with less agglomeration, allowing more efficient grinding of the mineral ore. Further, because the hydrolyzed starch affects the rheological properties of the mineral ore slurry and improves flow-ability, the invention also facilitates flow and pumpability of the slurry that discharges from a means for comminuting the mineral ore. Thus, the hydrolyzed starch improves the flow-ability of the ground mineral ore in pipes or other conduits and through pumps as the slurry is moved from the means for comminuting the mineral ore to other unit operations in a mining circuit and improves flow-ability and processability in unit operations downstream of the grinding operation.

The mineral ore slurry comprising water and mineral ore is added to the mill either continuously, such as through a feed pipe, or manually. The grinding aid composition is added to the mineral ore slurry either prior to the mineral ore slurry entering a grinding chamber(s) of the mill, such as in the feed pipe, prior to comminution or is added to the slurry when the slurry is in a grinding chamber(s) of the mill. Also the grinding aid composition can be added to the mineral ore slurry both prior to the mineral ore slurry entering the mill and while the mineral ore slurry is in the grinding chamber(s) of the mill. Accordingly, the grinding aid composition is applied in a method of wet grinding a mineral ore comprising adding an effective amount of a grinding aid comprising a hydrolyzed starch, such as those discussed above, to an aqueous slurry comprising the mineral ore and grinding the mineral ore with a means for comminuting the mineral ore, such as the aforementioned mills.

The typical mineral ores comprise base metals, precious metals or combinations of these. Some examples of minerals in base metals or precious metals that may comprise the mineral ore include a mineral selected from the group consisting of gold, aluminum, silver, platinum, copper, nickel, zinc, lead, molybdenum, iron, and the like, and combinations thereof. Other materials that may comprise the mineral ore include phosphate, coal, and the like, and combinations thereof.

In an aspect of the invention, the grinding aid composition is added to the mineral slurry, which is the aqueous slurry comprising the mineral ore, in an amount of about 0.005% to about 1.0% by dry weight of the mineral ore, preferably in an amount of about 0.01% to about 0.40% by dry weight of the mineral ore. Although the grinding aid composition is effective at a variety of solids content of the mineral slurry, typically, the solids content of the mineral slurry, that is the amount of mineral ore (mineral ore content) in the slurry, is at least about 30%, at least about 40%, at least about 50%, at least about 60%, at least about 70% or at least about 80%, such as about 50% to about 90%, like as about 60% to 80%. Persons of ordinary skill in these arts, after reading this disclosure, will appreciate that all ranges and values for the amount of grinding aid composition and solids content are contemplated.

Stickiness and particle size distribution are two attributes that are directly related to effectiveness of the grinding aid in the mineral ore slurry. The grinding aid composition decreases the stickiness of the mineral ore slurry while the ore fragments are being comminuted in the means for comminution. The grinding aid compositions are also found to adjust the particle size distribution of the mineral ore in the slurry. The dispersion affect of grinding aid composition allows the slurry to flow while the slurry is in the means for comminution so that impact in the means for comminution, such as between the ore particles and the balls in the mill, occur more frequently allowing for more effective grinding. The hydrolyzed starches, particularly those which are low molecular weight non-ionic oligomers, are assessed as grinding additives in the examples below.

EXAMPLES

The following grinding technique was applied for the examples.

An all-direction planetary ball mill, model XBM4X-VL, from Col-Int Tech, Columbia, S.C., USA was used for ore grinding. Four 1 liter stainless steel (SS) cups were placed in cup fixtures mounted onto a rotating disk turned 45° degrees to align the long axis of the cups horizontally to mimic a larger scale industrial ball mill orientation. Each cup was spun in opposite direction with respect to the disk rotation to create planetary motion during the grinding tests. The energy of grinding was adjusted by pre setting the frequency for the motor input as well as the duration of the test.

General procedure for ore grinding was as follows (unless specified differently). Variable amounts of dry ore and variable amounts of tap water were loaded into 1 liter 316 stainless steel cups with the grinding aid composition added prior to grinding as per the individual examples below. Fifteen, 20 mm, 316 stainless steel balls were placed in each loaded cup. The cups were fixed in the ball mill. Grinding was performed using 30 Hz energy input and 40 minutes test duration for gold ore and 20 minutes for other types of ore. In order to adjust the wet ore (slurry) concentration, a constant amount of ore was used with a variable amount of water to obtain mineral ore slurries having mineral ore content (% slurry) as identified in the individual examples below.

In each of the examples, the ground mineral ore/mineral ore slurry was analyzed for particle size distribution, stickiness, yield stress and viscosity using the following analytical procedures.

Dry Particle Size Analysis

The size distribution of particles was analyzed using a HELOS dry particle size analyzer from Sympatec GmbH, Clausthal-Zellerfield, Germany in accordance with manufacturer's instructions. This particle sizing method is based on an analysis of the angular dependence of light scattered from an optically dilute dispersed phase sample. The measuring instrument comprises a forward scattering angle photo ring diode detector and a number of discrete higher forward and back scattering angle photodiode detectors. The angular dependence of the scattered light is measured at two discrete wavelengths and a particle size distribution is iteratively generated to replicate the measured scattering profile. Average particle sizes (mean and median) and particle size distributions of powder are determined. The specific surface area of the material is calculated assuming the particles are solid, homogeneous spheres.

The particle size distribution was calculated by placing a powder sample of dried comminuted mineral, about ½ teaspoon in volume, on the vibrating table of the HELOS dry particle size analyzer. The sample was automatically dispersed through the laser system and the distribution curve was calculated automatically through the software embedded in the analyzer. Entire cumulative size distributions with mean numbers were summarized.

Stickiness

After the grinding process was complete, the grinding balls were removed from the cups leaving only slurry comprising ground ore in the containers. Four containers comprising the slurry were weighed. The slurries were then dumped from the containers by inverting the containers and lightly tapping the bottom of the each container two times. The stickiness is defined as the weight percent of wet ore that remains in the cup after "dumping" wet ground ore. If all the ore is quantitatively removed from the cup, the "stickiness" is equal to zero. Likewise, if none of the ore is quantitatively removed from the cup, the "stickiness" is equal to 100%. If some of the ore remained in the cup after dumping, the semi-empty containers were weighed, and the percent stickiness was then determined using the following equation.

$$\% \text{ Stickiness} = \frac{(\text{total ore \& water used}) - (\text{Weight of Dumped Slurry})}{\text{Total ore \& water used}} \times 100$$

Energy of Grinding

Energy Procedure:

The following procedure was used to measure the power draw of a ball mill grinder. The sample preparation procedure used in the Stickiness measurement was used in the Energy of Grinding procedure. A Universal Power Cell (Model: UPC), was connected on one end to the motor of the lab ball mill and the other end to a computer having a WinDaq™ program (other similar programs may be used for this), that is capable of measuring the power draw during ball mill operation.

Figure 2:
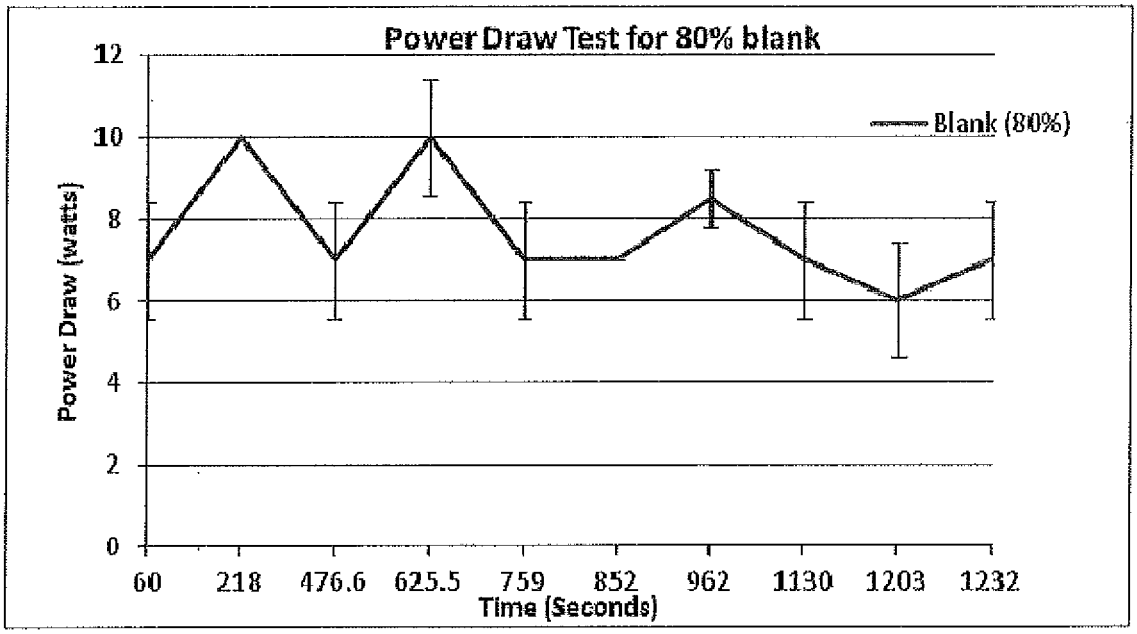
FIG. 2, shows the foaming tendency of the black liquor with the different defoamer emulsions relative to the black liquor without any defoamer.

The power draw of the ball mill was measured and recorded for 20 minutes during the grinding operation. Ten data points were collected and the data was plotted wherein the area under power draw over time for tumbling of the "empty" grinding jar containing only grinding balls (FIG. 1), is subtracted from energy for the ore wet grinding run, as shown in FIG. 2.

To find the area under the curve, and thus the % energy reduction the following equation was used:

$$\frac{(\text{Area under the blank curve}) - (\text{Area under the product curve})}{\text{Area under the Blank curve}} \times 100$$

Rheology—Yield Stress/Viscosity

Dynamic yield stress and apparent viscosity for mineral slurries prepared with and without grinding aid compositions were measured using TA Discovery HR-2 controlled stress rheometer with parallel plate's geometry from TA Instruments, Wilmington, Del., USA. The set up of the rheometer was similar to the one described in C. F. Ferraris, "*Measurements of the rheological properties of cement paste: a new approach*", NIST, in proceedings of RILEM Intern. Symposium, March, 1999, which is incorporated herein by reference in its entirety, for rheology measurements of cement pastes with both top/rotating and bottom/stationary plates made with serrated pattern having a depth of serration about 450 microns. This geometry prevents slippage during the measurements and gives very accurate yield stress readings. A gap of 1000 micron was used.

Dynamic yield stress and apparent viscosity at a given shear rate are the essential rheological characteristics to mimic slurry flow-ability in industrial ball mills with the shear rates selected in the range, about 13 $s^{-1}$ (reciprocal or inverse seconds) to about 730 $s^{-1}$. The lower the dynamic yield stress and the lower the apparent viscosity, the lower will be the energy required to initiate and maintain slurry flow-ability in the ball mill.

The slurry samples were vigorously shaken by hand at a constant pace for about 5 minutes and then immediately measured. The measuring protocol for shear stress-shear rate (using the TA Trios program from TA Instruments) included starting at zero ($s^{-1}$) ramping up to 2000 ($s^{-1}$) with 20 seconds/point, tested using linear scale and testing was repeated 2 times for each sample with 2 samples made in duplicate, hence providing 4 data points altogether for reporting an average dynamic yield stress and apparent viscosity. The shear stress versus shear rate curve (its linear segment at low shear rates) is extrapolated to zero shear rate with the y-intercept giving dynamic yield stress value. This is essentially a Bingham plastic flow curve analysis as described in T. Chen, "*Rheological techniques for yield stress analysis*", TA Instruments Application Paper—AAN017, which is incorporated herein by reference in its entirety.

The apparent viscosity was derived from shear stress and shear rate data using the following Cross model fitting equation for viscosity at 13 $s^{-1}$ and 730 $s^{-1}$.

$$\frac{\text{Viscosity} - b}{a - b} = \frac{1}{1 + (c \times \text{rate})^d}$$

The variables are defined as follows.

a=Zero-Rate Viscosity b=Infinite-Rate Viscosity c=Consistency d=Rate Index

Using the analysis tools in the TA Trios system, one can fit the shear stress-shear rate experimental flow curve with the Cross model and find the viscosities at different shear rates by setting the parameters after fitting the curve.

Example 1

Comparative

Gold ore with the particle size distribution characterized by 100% of the material below ⅜ of an inch was obtained from a North American mine and dried to remove residual moisture. The gold ore was ground applying the equipment and procedures described above. The ground samples were then tested for particle size distribution, stickiness, yield stress and viscosity using the analytical procedures described above. The results are summarized in Table 1 below. The data in Table 1 represents an average of 2 to 4 repetitive runs.

TABLE 1

| % Slurry | Amount of Ore (gram) | Amt. of Water | Total Slurry Wt. (gram) | % Stickiness | Yield Stress (D/cm$^2$) | Viscosity (Pas) at 13 s$^{-1}$ | Viscosity (Pas) at 730 s$^{-1}$ |
|---|---|---|---|---|---|---|---|
| 50 | 150 | 150 | 300 | 1.01 | 1.00 | 0.1000 | 0.0 |
| 60 | 150 | 100 | 250 | 17.95 | 33.49 | 1.2056 | 0.1422 |
| 70 | 150 | 64 | 214 | 59.40 | 90.53 | 5.5003 | 0.2650 |
| 80 | 150 | 37 | 187 | 100 | 1708.58 | 128.124 | 2.3196 |

The characteristics of ground gold ore change dramatically with increase in slurry concentration. The slurry at 50% by weight is very fluid and visually inform. The slurry remains fluid at 60% by weight, while there is some heterogeneity observed. Increasing the solids content to 70% by weight resulted in a strong jump in slurry viscosity that looked fairly viscous and non-uniform with reaching paste-like behavior at 80% solids content by weight. Ore slurry stickiness, viscosity and yield stress undergo dramatic jump above 60% by weight of slurry concentration indicating strong agglomeration of ground ore and increase in cohesive/adhesive forces.

As indicated in Table 2, the particle size distribution of ground gold ore as measured by HELOS dry particle size analyzer, showed a fairly uniform pattern with medium particle size around 20 micron with the largest size fraction of about 70 micron to about 100 micron representing less than 10% of ground material. There was no effect of slurry concentration on the ground, dry ore particle size distribution within the experimental error, resulting in a mean particle size of 20 micron as shown in Table 2 for gold ore. Note that in Table 2 Additive refers to the grinding aid composition.

TABLE 2

| Ore Type | % Solids | pH | Particle size, micron/other, before grinding | Particle size, micron, after grinding/blank | Particle size, micron, after grinding/with addititve |
|---|---|---|---|---|---|
| Bauxite | 84.36 | 7.10 | 85.0 | 13 | 12.9 |
| Phosphate | 100 | 7.01 | 96.5 | 24 | 22 |
| Copper | 95.6 | 5.85 | 56.9 | 12 | 17 |
| Gold | 99.1 | 11 | ⅜ inch | 22 | 20 |

(Note: medium particle size is given in the table for all samples but gold before grinding, for which visual average particle size was reported).

Example 2

In this example maltodextrin in an amount of 0.02% by dry weight of the mineral ore was added to 150 grams (gm) of gold ore that is the same as described above for Example 1 and 64 grams of water to make a slurry having a 70% mineral ore content as set forth in Table 3. Maltodextrin, in dry form (MD 01956), from Cargill, Incorporated, Minneapolis, Minn., USA ("Cargill") was used, which is noted in the Additive column in Table 3. The slurry was ground using the equipment and procedures described above. The ground ore was analyzed for stickiness, viscosity and yield stress using the procedures described above. The analytical results for this example are summarized in Table 3 below with reference to the maltodextrin Additive. Maltodextrin addition results' in strong decrease in ore stickiness, viscosity and yield stress compared to 70% by weight slurry without additive, used as the control (from Example 1 with results repeated in Table 3).

TABLE 3

| % Slurry | Additive | Amount (wt %) | Amount of Ore, (gm) | Amount of Water, (gm) | Total Slurry Weight, (gm) | % Stickiness | Yield Stress (D/cm2) | Viscosity (Pa · s) at 13 s−1 | Viscosity (Pa · s) at 730 s−1 |
|---|---|---|---|---|---|---|---|---|---|
| 70 | None | 0 | 150 | 64 | 214 | 59.40% | 90.53 | 5.5003 | 0.2650 |
| 60 | None | 0 | 150 | 100 | 250 | 17.95% | 33.49 | 1.2056 | 0.1422 |
| 70 | Maltodextrin 01956 | 0.02 | 150 | 64 | 214 | 25.75% | 60.31 | 4.4528 | 0.2178 |
| 70 | Dextrin Plus 8702 | 0.02 | 150 | 64 | 214 | 27.77% | 73.03 | 4.2769 | 0.2118 |
| 70 | Star-Dri Corn Syrup 42C | 0.02 | 150 | 64 | 214 | 36.33% | 89.53 | 5.9764 | 0.2756 |

The results indicate that maltodextrin is effective in controlling gold ore slurry flow-ability which can result in improved throughput of ore grinding without negative issues, such as increased ore stickiness and viscosity. High ore stickiness can result in ball mill motor bearing damage due to agglomerated ore drop and weight impact during balling. Also, the ore with high viscosity and stickiness is very difficult to discharge from a ball mill and would be impossible to transport to the next point downstream in a commercial mining operation. Finally, gold ore excessive agglomeration can result in less effective grinding of ore reflected in a larger fraction of coarser material.

In this example and others described herein a fairly high ball mill energy input was used. As a result, the particle size distribution was essentially the same for the final ground ore with the grinding aid compositions and controls without any such additive. However, the grinding aid compositions provide for beneficial rheological properties which will facilitate commercial mining grinding and throughput to subsequent unit operations in the mining process.

Example 3

In this example the grinding aid composition comprised dextrin in dry powder, Dextrin Plus 8702 from Cargill, which is noted in the Additive column in Table 3. The dextrin was incorporated through addition to water phase prior to ball mill testing. Dextrin in an amount of 0.02% by dry weight of the mineral ore was added to 150 grams of gold ore that is the same as described above for Example 1 and 64 grams of water to make slurry having a 70% by weight mineral ore content as set forth in Table 3. The slurry was ground using the equipment and procedures described above. The ground ore was analyzed for stickiness, viscosity and yield stress using the procedures described above. The results of the dextrin impact at 0.02% by dry weight per mineral ore are shown in Table 3 with respect to the dextrin additive. Dextrin reduces stickiness, viscosity and yield stress for 70% by weight mineral ore slurry. Particle size distribution of the dried, ground ore with added dextrin was similar to the comparative examples describe above in Example 1.

Example 4

In this example the grinding aid composition comprised corn syrup solids, Star Dry Corn Syrup 42C from Tate & Lyle PLC, London, United Kingdom, which is noted in the Additive column in Table 3. The corn syrup solids were incorporated through addition to water phase prior to ball mill testing. Corn syrup solids in an amount of 0.02% by dry weight of the mineral ore was added to 150 grams of gold ore, that is the same as described above for Example 1, and 64 grams of water to make a slurry having 70% by weight mineral ore content as set forth in Table 3. The slurry was ground using the equipment and procedures described above. The ground ore was analyzed for stickiness, viscosity and yield stress using the procedures described above. The results of the corn syrup solids impact at 0.02% by dry weight per mineral ore are shown in Table 3, with respect to corn syrup solids additive. The corn syrup solids showed significant reduction in stickiness but no reduction in viscosity and yield stress as shown in Table 3. Particle size distribution of the dried, ground ore with corn syrup solids was similar to the comparative examples describe above in Example 1.

Example 5(a)

Grinding aid composition comprising maltodextrin (MD 01956 from Cargill as identified as Additive in Table 4) was used with the gold ore slurry in an amount of 0.1% by dry weight of mineral ore as shown in Table 4 to make slurry having 80% by weight mineral ore content. The slurry was ground using the equipment and procedures described above. The ground ore was analyzed using the procedures described above and the results, along with the results for some comparative examples where no grinding aid was used with gold ore, are set forth in Table 4.

TABLE 4

| % Slurry | Additive | Amt. (wt %) | Amt. of Ore (gm) | Amt. of Water (gm) | Total Slurry Wt. (gm) | % Stickiness | Yield Stress (D/cm$^2$) | Viscosity (Pas) at 13 s$^{-1}$ | Viscosity (Pas) at 730 s$^{-1}$ |
|---|---|---|---|---|---|---|---|---|---|
| 70 | None | 0 | 200 | 85 | 285 | 24.00 | 62.83 | 3.1132 | 0.1970 |
| 80 | None | 0 | 200 | 50 | 250 | 100 | 1479.03 | 100.9728 | 2.1406 |
| 80 | Maltodextrin 01956 | 0.1 | 200 | 50 | 250 | 54.05 | 630.25 | 43.2857 | 1.4066 |

When 80% by weight mineral gold ore is ground, the resultant slurry shows extreme (100%) stickiness, paste-like behavior with very high viscosity and yield stress. The addition of 0.1% maltodextrin by dry weight of the mineral ore to this slurry prior to grinding results in substantial change in ground slurry characteristics, i.e. decrease in stickiness, viscosity and yield stress. The slurry starts to show flow-ability, approaching the behavior of 70% by weight mineral ore slurry without additives, hence reinforcing strong anti-agglomerating benefits of the maltodextrin.

Example 5(b)

Energy difference has been measured during grinding of a gold ore with and without MD 01956 product as described in example 5(a) in an amount of 0.1% by dry weight of mineral ore to make gold slurry having 70% by weight mineral ore content.

Figure 3:
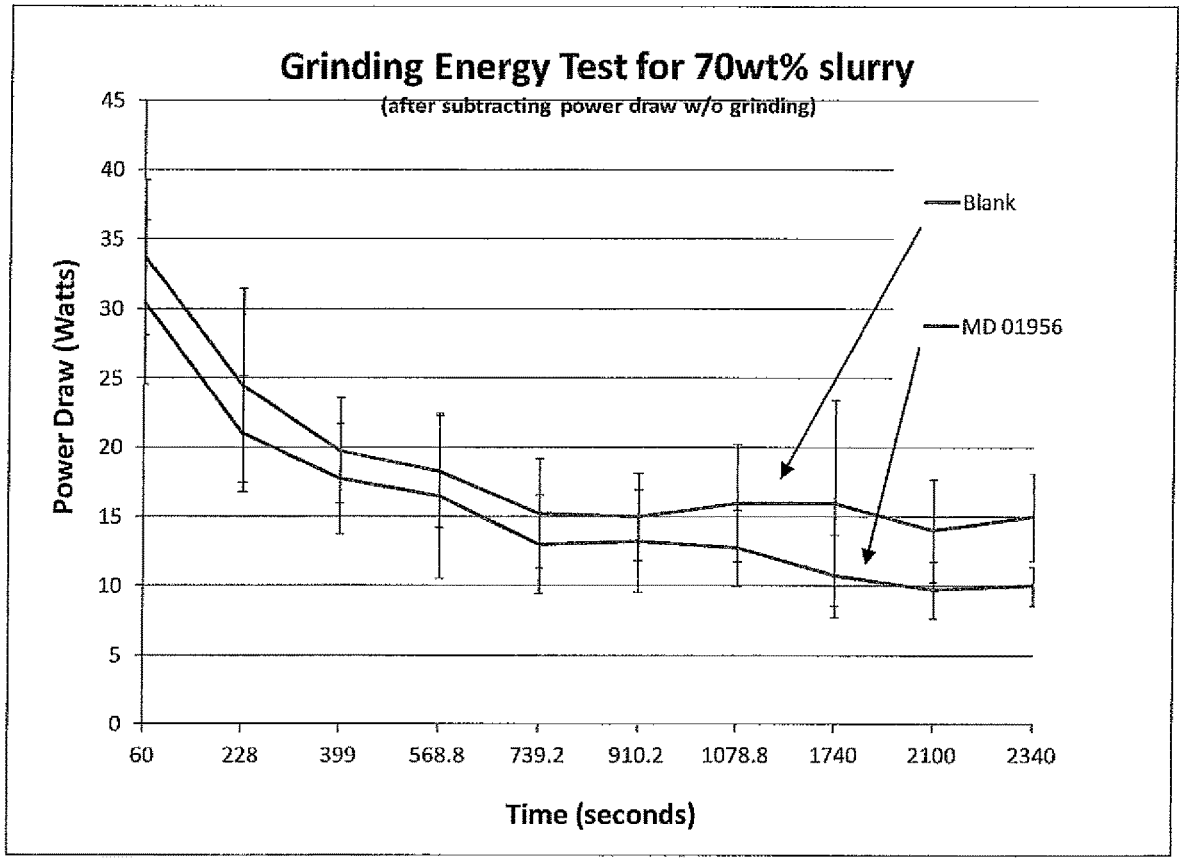
FIG. 3, shows the median drop size of the emulsion sampled from the product stream as a function of time for both the steady state mode and the continuous mode.

The results are shown in FIG. 3, resulting in a 21% decrease in grinding energy for the case of the MD 01956 added.

Example 6

In this example, separate grinding aid compositions comprising the maltodextrin, dextrin and corn syrup solids described in the examples above (identified as Additive in Table 5) were added to bauxite ore and water, in the amounts set forth in Table 5, to make bauxite ore slurries with grinding aid composition in an amount of 0.1% by dry weight of the mineral ore. The slurry was ground using the equipment and procedures described above. The ground ore was analyzed for stickiness, viscosity and yield stress using the procedures described above. Control experiments set forth in Table 5 below included ground bauxite ore characteristic measurements at 57% by weight mineral ore and 63% by weight mineral ore in aqueous slurry. The results are summarized in Table 5. In all cases where the grinding aid composition was used there is a decrease in ore slurry stickiness, yield stress and viscosity characteristics. The pH and pre-grind and post-grind average particle sizes for the bauxite slurry are set forth in Table 2.

TABLE 5

| % Slurry | Additive | Amt. (wt %) | Amt. of Ore (gm) | Amt. of Water (gm) | Total Slurry Wt. (gm) | % Stickiness | Yield Stress (D/cm$^2$) | Viscosity (Pas) at 13 s$^{-1}$ | Viscosity (Pas) at 730 s$^{-1}$ |
|---|---|---|---|---|---|---|---|---|---|
| 57 | None | 0 | 237.08 | 119.9 | 357 | 25.6% | 100.71 | 3.7120 | 0.1902 |
| 63 | None | 0 | 237.08 | 77.92 | 315 | 69.0% | 268.39 | 16.4278 | 0.4653 |
| 63 | MD01956 | 0.1 | 237.08 | 77.92 | 315 | 56.5% | 220.47 | 14.3363 | 0.4076 |
| 63 | Dextrin Cargill Plus 8702 | 0.1 | 237.08 | 77.92 | 315 | 54.0% | 198.06 | 12.5778 | 0.3706 |
| 63 | Star-Dri Corn Syrup 42C | 0.1 | 237.08 | 77.92 | 315 | 48.4% | 214.68 | 13.0169 | 0.3982 |

Example 7

In this example, separate grinding aid compositions comprising the maltodextrin, dextrin and corn syrup solids described in the examples above (identified as Additive in Table 6) were added to copper mineral ore and water, in the amounts set forth in Table 6, to make copper mineral ore slurries with grinding aid composition in an amount of 0.1% by dry weight of the mineral ore. The slurry was ground using the equipment and procedures described above. The ground ore was analyzed for stickiness, viscosity and yield stress using the procedures described above. Control experiments set forth in Table 6 below included ground copper mineral ore characteristics measurements at 70% by weight mineral ore and 80% by weight mineral ore in aqueous slurry. The results are summarized in Table 6. In all cases where the grinding aid composition was used there is a decrease in ore slurry stickiness, yield stress and viscosity characteristics. All of the grinding aid compositions tested in this example show very strong impact on stickiness, viscosity and yield stress of copper ore slurry resulting in pronounced decrease in all characteristics and increase in ore slurry flow-ability. The pH and pre-grind average particle size are shown in Table 2.

Example 8

In this example, separate grinding aid compositions comprising the maltodextrin, dextrin and corn syrup solids described in the examples above (identified as Additive in Table 7) were added to phosphate ore and water, in the amounts set forth in Table 7, to make phosphate ore slurries with grinding aid composition in an amount of 0.1% by dry weight of the mineral ore. The slurry was ground using the equipment and procedures described above. The ground ore was analyzed for stickiness, viscosity and yield stress using the procedures described above. Control experiments set forth in Table 7, include ground copper mineral ore characteristics measurements at 70% by weight mineral ore and 75% by weight mineral ore in aqueous slurry. The results are summarized in Table 7. The grinding aid compositions tested in this example resulted in reduced ore stickiness, yield stress and viscosity, as shown in Table 7. The pH and average pre-grind particle size are set forth in Table 2.

TABLE 6

| % Slurry | Additive | Amount (wt %) | Amount of Ore, (gm) | Amount of Water, (gm) | Total Slurry Weight, (gm) | % Stickiness | Yield Stress (D/cm2) | Viscosity (Pa · s) at 13 s−1 | Viscosity (Pa · s) at 730 s−1 |
|---|---|---|---|---|---|---|---|---|---|
| 70 | None | 0 | 209.21 | 75.79 | 285 | 30.6% | 70.40 | 3.4434 | 0.1695 |
| 80 | None | 0 | 209.21 | 40.76 | 250 | 100.0% | 1019.52 | 70.4181 | 1.4127 |
| 80 | MD 01956 | 0.1 | 209.21 | 40.76 | 250 | 53.0% | 371.85 | 34.8694 | 0.7329 |
| 80 | Dextrin Cargil Plus 8702 | 0.1 | 209.21 | 40.76 | 250 | 67.5% | 237.08 | 16.4790 | 0.4860 |
| 80 | Star-Dri Corn Syrup 42C | 0.1 | 209.21 | 40.76 | 250 | 79.1% | 619.24 | 47.4601 | 0.9266 |

TABLE 7

| % Slurry | Additive | Amount (wt %) | Amount of Ore, (gm) | Amount of Water, (gm) | Total Slurry Weight, (gm) | % Stickiness | Yield Stress (D/cm2) | Viscosity (Pa · s) at 13 s−1 | Viscosity (Pa · s) at 730 s−1 |
|---|---|---|---|---|---|---|---|---|---|
| 70 | None | 0 | 200 | 85 | 285 | 35.4% | 129.99 | 7.5774 | 0.2775 |
| 75 | None | 0 | 200 | 66 | 266 | 75.7% | 395.28 | 30.5011 | 0.7926 |
| 75 | MD 01956 | 0.1 | 200 | 66 | 266 | 69.6% | 379.79 | 29.2657 | 0.7583 |
| 75 | Dextrin Cargil Plus 8702 | 0.1 | 200 | 66 | 266 | 56.6% | 331.17 | 25.1445 | 0.6663 |
| 75 | Star-Dri Corn Syrup 42C | 0.1 | 200 | 66 | 266 | 55.4% | 398.08 | 26.7983 | 0.7256 |

While the present invention has been described with respect to particular embodiments thereof, it is apparent that numerous other forms and modifications will be obvious to those skilled in the art. The invention described in this application generally should be construed to cover all such obvious forms and modifications, which are within the true scope of the present invention.

We claim:

1. An aqueous mineral ore slurry comprising:

a mineral ore; and a non-ionic grinding aid consisting essentially of maltodextrin, wherein the aqueous mineral ore slurry includes from 0.005% to 1.0% maltodextrin, by dry weight of the mineral ore.

2. The mineral ore slurry of claim 1 wherein the mineral ore is aluminum.

3. The mineral ore slurry of claim 1 wherein the mineral ore comprises a mineral selected from the group consisting of gold, aluminum, silver, platinum, copper, nickel, zinc, lead, molybdenum, iron and combinations thereof, or a component selected from the group consisting of a metal, coal, phosphate and combinations thereof.

4. The mineral ore slurry of claim 1 comprising from 0.01% to 0.4% of the maltodextrin by dry weight of the mineral ore.

5. The mineral ore slurry of claim 1 wherein the aqueous phase has a mineral ore content of at least 30% by weight.

6. The mineral ore slurry of claim 1 wherein the aqueous phase has a mineral ore content of at least 50% by weight.

7. The mineral ore slurry of claim 1 wherein the aqueous phase has a mineral ore content of from 60% by weight to 80% by weight.

8. The mineral ore slurry of claim 1 wherein the mineral ore is gold.

9. A method of wet grinding a mineral ore comprising:

adding an effective amount of a non-ionic grinding aid consisting essentially of maltodextrin to an aqueous slurry comprising the mineral ore, such that the aqueous mineral ore slurry includes from 0.005% to 1.0% maltodextrin, by dry weight of the mineral ore; and grinding the mineral ore.

10. The method of claim 9 wherein the mineral ore is aluminum.

11. The method of claim 9 wherein the mineral ore is gold.

12. The method of claim 9 wherein the mineral ore comprises a mineral selected from the group consisting of gold, aluminum, silver, platinum, copper, nickel, zinc, lead, molybdenum, iron and combinations thereof, or a component selected from the group consisting of metal, coal, phosphate and combinations thereof.

13. The method of claim 9 wherein the aqueous mineral ore slurry includes from 0.01% to 1.0% maltodextrin by dry weight of the mineral ore.

14. The method of claim 13 wherein the aqueous mineral ore slurry includes from 0.01% to 0.40% maltodextrin by dry weight of the mineral ore.

15. The method of claim 9 wherein the aqueous slurry has a mineral ore content of at least 30% by weight.

16. The method of claim 9 wherein the aqueous slurry has a mineral ore content of at least 50% by weight.

17. The method of claim 9 wherein the aqueous phase has a mineral ore content of from 60% by weight to 80% by weight.

18. The method of claim 9 wherein grinding the mineral ore comprises grinding the mineral ore with a device selected from the group consisting of a ball mills, rod mills, autogenous mills, semi-autogenous mills, pebble mills, high pressure grinding mills, burhstone mills, vertical shift impactor mills and tower mills.

* * * * *